US006655250B1

(12) United States Patent
Ishii et al.

(10) Patent No.: US 6,655,250 B1
(45) Date of Patent: Dec. 2, 2003

(54) PUNCHING APPARATUS

(75) Inventors: Toru Ishii, Hamamatsu (JP); Shinobu Kawase, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/564,524

(22) Filed: May 4, 2000

(30) Foreign Application Priority Data

May 13, 1999 (JP) ..... 11-133224

(51) Int. Cl.[7] ..... B26D 7/26

(52) U.S. Cl. ..... 83/559; 83/410.9; 83/412; 83/620; 83/685; 83/699.31

(58) Field of Search ..... 83/36, 240, 410.9, 83/412, 559, 620, 623, 640, 641, 686, 688, 685, 689, 698.91, 698.31, 216, 917, 916, 560, 562, 34, 49, 693

(56) References Cited

U.S. PATENT DOCUMENTS

| | | | | | |
|---|---|---|---|---|---|
| 3,440,910 | A | * | 4/1969 | Scribner | 83/559 |
| 3,839,937 | A | * | 10/1974 | Memain | 83/34 |
| 4,143,571 | A | * | 3/1979 | Oxenham | 83/412 |
| 4,162,641 | A | * | 7/1979 | Stubbings | 83/412 X |
| 4,165,667 | A | * | 8/1979 | Brolund et al. | 83/412 X |
| 4,412,469 | A | * | 11/1983 | Hirata et al. | 83/552 |
| 4,606,250 | A | * | 8/1986 | Krosbacher et al. | 83/161 |
| 4,674,373 | A | * | 6/1987 | Kuppinger | 83/559 X |
| 4,696,211 | A | * | 9/1987 | Bitzel | 83/559 X |
| 4,703,678 | A | * | 11/1987 | Kiuchi | 83/559 X |
| 4,843,704 | A | * | 7/1989 | Sakamoto et al. | 83/559 X |
| 4,869,141 | A | * | 9/1989 | Klingel | 83/49 |
| 5,787,775 | A | * | 8/1998 | Stevens et al. | 83/34 |

FOREIGN PATENT DOCUMENTS

| | | |
|---|---|---|
| JP | 47-13786 | 7/1972 |
| JP | 60-190424 | 12/1985 |
| JP | 62-159925 | 10/1987 |
| JP | 4-159100 | 6/1992 |
| JP | 6-699 | 1/1994 |
| JP | 6-126497 | 5/1994 |
| JP | 6-50158 | 12/1994 |
| JP | 8-323694 | 12/1996 |
| JP | 10-217198 | 8/1998 |
| JP | 10-323726 | 12/1998 |

OTHER PUBLICATIONS

Japanese Office Action issued Jul. 14, 2002 and Information Submission Form issued Jun. 25, 2002 (English translation of relevant portions).

* cited by examiner

*Primary Examiner*—Boyer D. Ashley
(74) *Attorney, Agent, or Firm*—Dickstein, Shapiro, Morin & Oshinsky, LLP.

(57) ABSTRACT

A punching apparatus is provided capable of punching a non-circular hole at a predetermined position on a work even when the rotatable range of the work setting is restricted. In the punching apparatus for punching a non-circular hole at a predetermined position of the work, said punch and said die are constituted such that said punch supported by the punch supporting portion is relatively rotatable and stoppable for said punch supporting portion about the central axis line of the punching direction; and, similar to said punch, said die is rotatable and stoppable about the central axis line of the punching direction in the identical rotational phase with said punch.

14 Claims, 5 Drawing Sheets

PUNCHING APPARATUS

BACKGROUND OF THE INVENTION

1. Field of the Invention

The present invention relates to a punching apparatus which punches a hole at a predetermined location by means of a punch and a die.

2. Background Art

There is a type of punching apparatus, in which the punch and the die are in the form of non-circular (for example, quadrangle) cross-section.

Conventionally, the problem has been encountered that since the conventional punching apparatus is constructed such that the punch and the die are permanently arranged (static setting) at predetermined locations, a work or an item to be punched must be set so as to coincide with the setting condition of the punch and the die.

Now, sometimes it becomes necessary to rotate the work when setting the work so as to coincide with the setting conditions of the punch and the die. In some cases, however, it becomes impossible to punch a non-circular hole, since the rotation range of the work is restricted.

SUMMARY OF THE INVENTION

It is therefore an objective of the present invention to provide a punching apparatus capable of punching a hole by means of a punch and a die both having non-circular cross-sections.

According to the first aspect of the present invention, in a punching apparatus for punching a hole having a non-circular cross section at a predetermined location on a work by means of a punch and a die, the punch and the die are constituted such that the punch is rotatable relative to the punch supporting portion about the central axis line of the punching direction and fixable at a rotational position around the central axis line of punching direction; and, similar to said punch, said die is rotatable about the central axis line of the punching direction with the same rotational phase as that of said punch, and is fixable at a rotational position around the central axis line of the punching direction.

The above described punching apparatus is constituted such that a supporting portion of said work is movable in two horizontal directions in a plane which crosses the punching direction at an approximately right angle and is swingable about a base point; a connecting means is provided for integrally connecting said punch and said die in order to rotate both said punch and said die at an identical rotational phase; and it is also possible to adopt an detachable connecting means for integrally connecting said punch and said die in order to rotate both said punch and said die at an identical rotational phase.

DETAILED DESCRIPTION OF THE INVENTION

Figure 1:
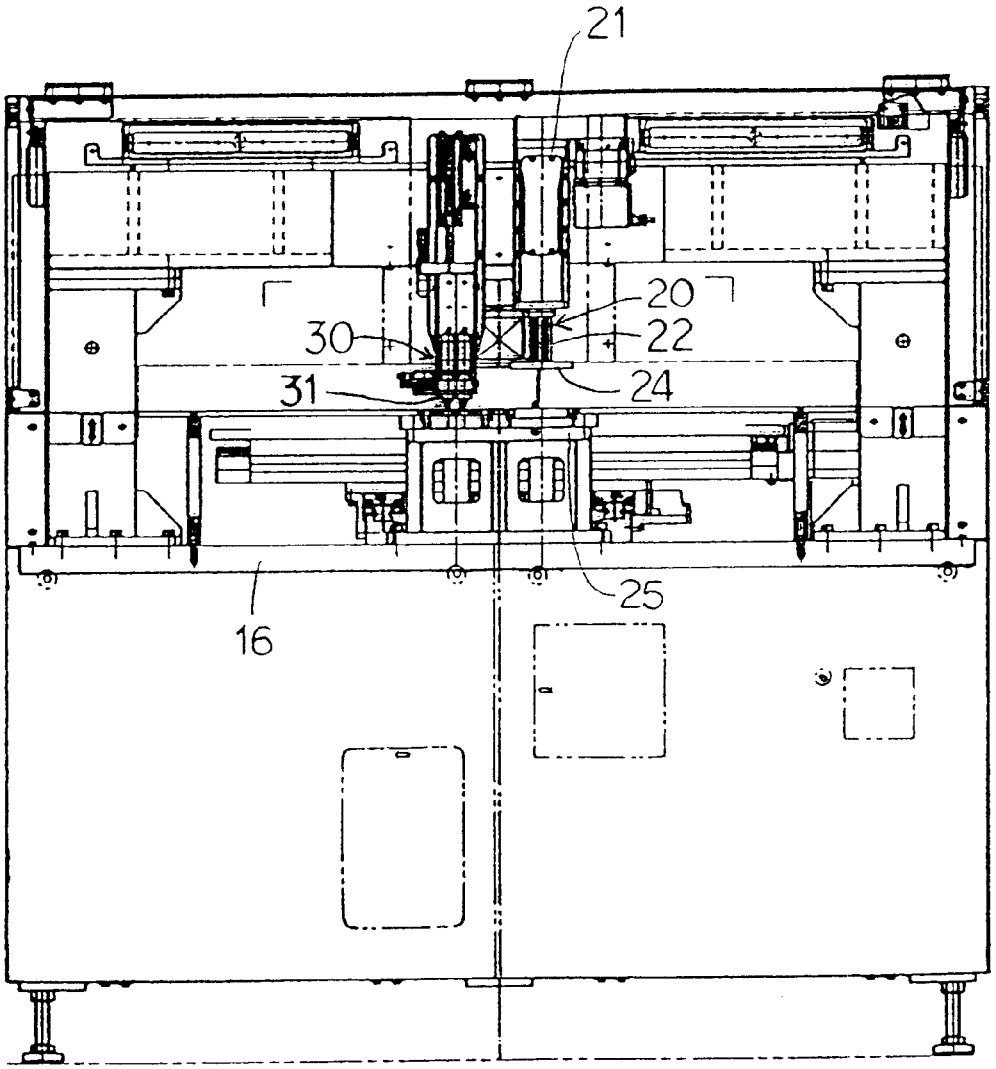
FIG. 1 is a diagram showing a front view of a punching apparatus according to one embodiment of the present invention.
Figure 2:
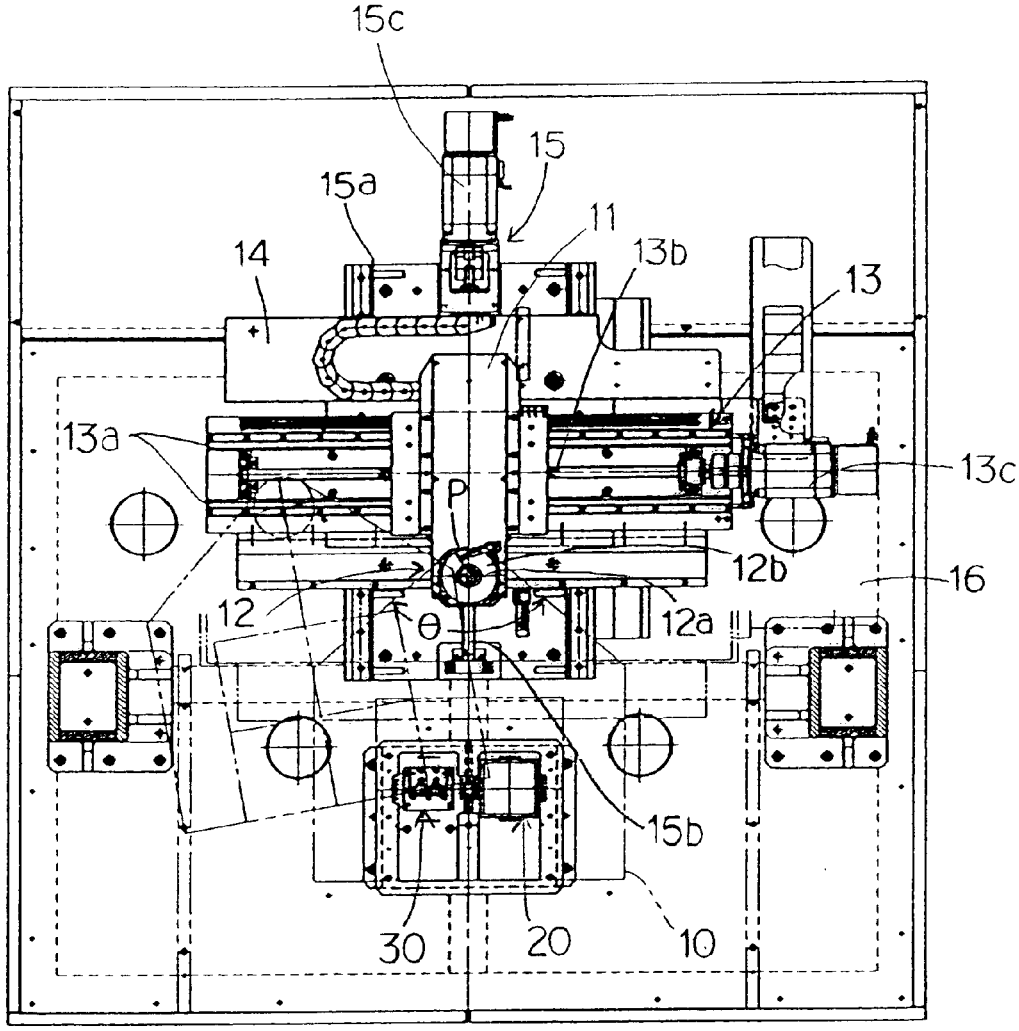
FIG. 2 is a diagram showing a plan view of a punching apparatus shown in FIG. 1.

Hereinafter, one embodiment of the present invention is described with reference to the attached drawings. A punching apparatus shown in FIGS. 1 and 2 is suitable for the punch machining of sheet type works for multiple product and small quantity production. The punching apparatus comprises a work supporting portion 10 (not shown in FIG. 1) for supporting a work (not shown), a puncher portion 20, and an image pickup portion 30.

The work supporting portion 10 is used for supporting by clamping at a predetermined location and is mounted on the upper movable carriage 11 through a θ-direction transfer mechanism 12 so as to be able to swing in the angular direction horizontally about a base center point P. The upper movable carriage 11 is disposed on a machine base 16 through an X-axis direction transfer mechanism 13, a intermediate movable carriage 14, and Y-axis direction transfer mechanism 15 so as to be movable in two directions (X-axis direction and Y-axis direction).

The θ-direction transfer mechanism 12 comprises a supporting axis 12*a* attached suspended under the work supporting portion 10 and a servo motor 12*b* for driving rotation of the supporting axis 12*a*. The θ-direction transfer mechanism 12 is capable of driving or stopping the work supporting portion 10 at an arbitrary angle about the base center point.

The X-axis direction transfer mechanism 13 comprises a pair of guide rails 13*a*, mounted on the intermediate movable carriage 14 for supporting the upper movable carriage 11 slidably in the X-axis direction, a screw feed mechanism 13*b* disposed between both guide rails 13*a* for feeding the upper movable carrier 11 in the X-axis direction, and a servo-motor 13*c* for driving rotation of a lead screw of the screw feed mechanism 13*b* at one end, such that the upper movable carrier 11 can be moved and stopped at a desired position in the X-axis direction by controlling the rotation of the servo-motor 13*c* by means of a controller (not shown).

The Y-axis direction transfer mechanism 15 comprises a pair of guide rails 15*a* mounted on a machine base 16 for supporting the intermediate movable carrier 14 slidably in the Y-axis direction, a screw feed mechanism 15*b* disposed between both rails for transferring the intermediate movable carriage 14 in the Y-axis direction, and a servo-motor for driving rotation of a lead-screw of the screw feed mechanism 15*b*, such that the intermediate movable carrier 11 can be moved and stopped at a desired position in the Y-axis direction by controlling the rotation of the servo-motor 15*c* by means of a controller (not shown).

Figure 3:
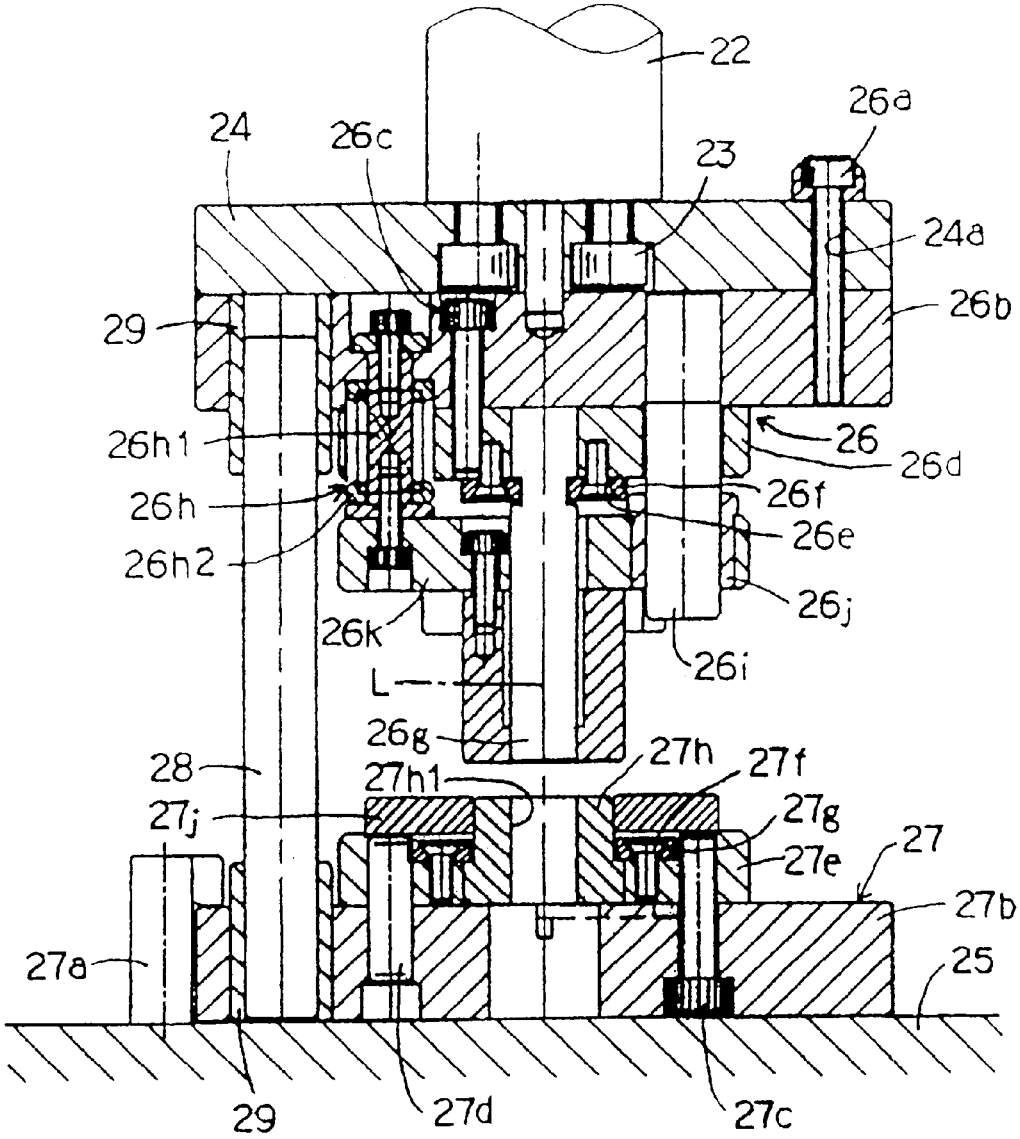
FIG. 3 is a partially sectioned diagram showing the puncher portion shown in FIG. 2 assembled with a punch pin and a die unit by a connecting pin.
Figure 4:
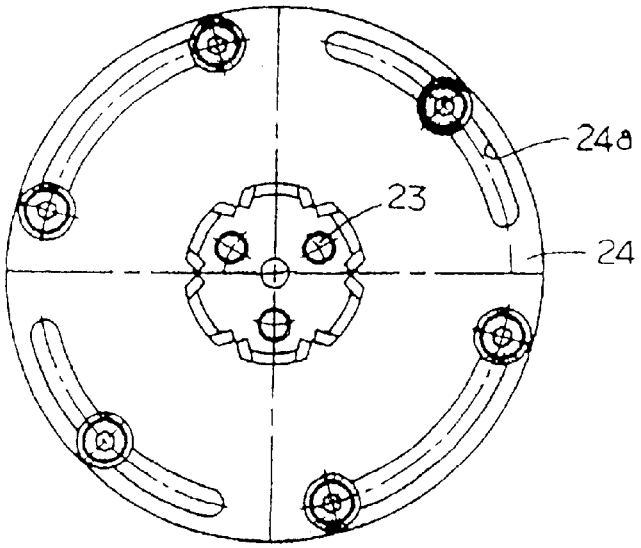
FIG. 4 is a diagram showing a plan view of a punch holder shown in FIGS. 2 and 3.

The puncher portion 20 is a portion for executing non-circular hole punching (in particular, the quadrangle). As shown in FIGS. 1, 3, and 4, the puncher portion comprises a punch holder 24 and a die holder 25. The punch holder 24 is integrated with one end of a rod 22 (not rotatable), which moves up and down by a hoisting device, using three bolts 23, and has four slot holes 24*a* in the form of circular arc around a periphery of the rod 22. The die holder 25 is disposed facing the punch holder 24 on the machine base 16. As shown in FIG. 3, a punch unit 26 is attached to the punch holder 24 so as to rotate about the central axis line L of the punching direction (vertical direction) and also can be integrally fixed at a desired position in the punching direction. A die unit 27 is attached to the die holder 25 so as to rotate about the central axis line L of the punching direction and can be integrally fixed at a desired position in the punching direction.

Figure 5:
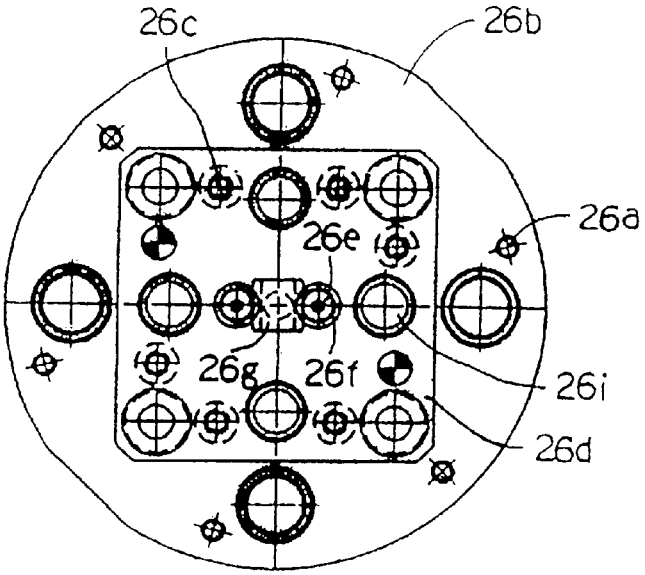
FIG. 5 is a diagram showing a bottom view of the punch unit (in which the spring unit, a bush, and a work presser foot are removed) shown in FIG. 3.

As shown in FIGS. 3 to 5, the punch unit 26 comprises, an approximately circular base plate 26*b*, integrated with the punch holder 24 by means of six fastening fixing bolts 26*a* which are inserted and screwed through the slot hole 24*a* of the non-rotatable punch holder 24. A rectangular support plate 26*d* is integrated with the base plate 26*b* by means of four fixing bolts 26*c*. A punch 26*g* with a quadrangle cross-section is integrated with the support plate 26*d* by means of two screws 26*e* and two washers 26*f*; and a work presser foot 26*k* is integrated so as to be movable vertically (movable upward from the position shown in FIG. 3) by means of four sets of spring units 26*h*, four guide pins 26*i*, and bushings 26*j*.

The upper end of the guide pin 26*i* is fastened to the base plate 26*b*, and the lower end of the guide pin supports the work presser foot 26*k* slidably in the vertical direction. Each bushing 26*j* is attached to the work presser foot 26*k* and each bushing 26*j* helps smooth sliding of the guide pin 26*i*. Each spring unit 26*h* comprises a pin 26*h*1 which is integrated with the work presser foot 26*k* and which engages with the base plate 26*b* detachably in the upward direction; and a compression coil spring 26*h*2 disposed around the pin 26*h*2 between the base plate 26*b* and the work presser foot 26*k*. Here, the spring unit, the bushing 26*j*, and the work presser foot 26*k*are shown only in FIG. 3.

The upper end of the guide pin 26*i* is fastened to the base plate 26*b*, and the lower end of the guide pin supports the work presser foot 26*k* slidably in the vertical direction. Each bush 26*j* is attached to the work presser foot 26*k* and each bush 26*j* helps smooth sliding of the guide pin 26*i*. Each spring unit 26*h* comprises a pin 26*h*1 which is integrated with the work presser foot 26*k* and which engages with the base plate 26*b* detachably in the upward direction; and a compression coil spring 26*h*2 disposed around the pin 26*h*2 between the base plate 26*b* and the work presser foot 26*k*. Here, the spring unit, the bush 26*j*, and the work presser foot 26*k* are shown only in FIG. 3.

Figure 6:
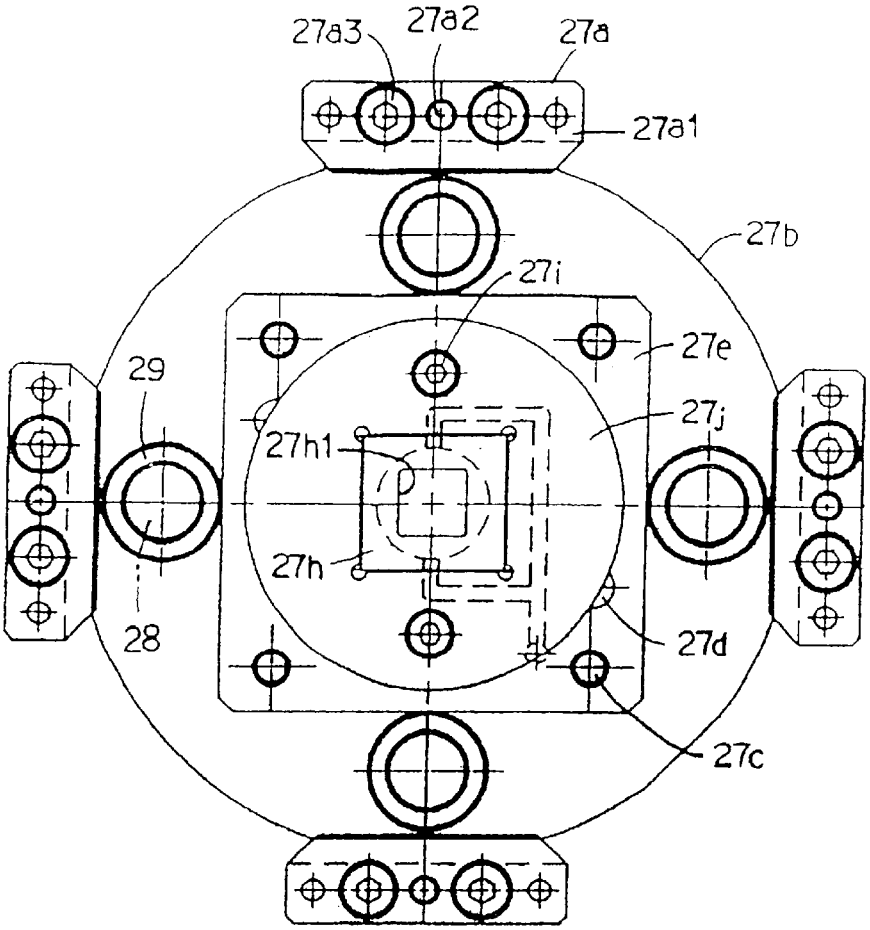
FIG. 6 is a diagram showing a plan view of the die unit.

As shown in FIGS. 3 and 6, the die unit 27 comprises a base plate 27*b* integrated with the die holder 25 having a fixed relationship with the body of the present apparatus by means of four unit presser foots 27*a*. A rectangular support plate 27*e* is integrated with the base plate 27*b* by means of four fixing bolts and two pins 27*d*. A die 27*h*, having a quadrangular hole in which the punch 26*g* can be inserted to a predetermined depth, is integrated with the support plate 27*e* by means of two screws 27*f* and washers 27*g*. A circular die cover 27*j* is integrated with the support plate 27*e* by means of two fixing bolts 27*i*. Each unit presser foot 27*a* comprises a block 27*a*1 having a claw portion at the upper portion for engaging with the support plate 27*e*, a pin 27*a*2 for fixing the block 27*a*1 at a home position and a pair of fixation bolts 27*a*3.

As shown in FIG. 3, in the present embodiment, the base plate 26*b* of the punch unit 26 and the base plate 27*b* of the die unit 27 are connected through four connecting pins 28 and a pair of up and down bushings 29 (fixed at each base plate) such that the punch 26*g* and the die 27*h* can be rotated integrally in the same rotational phase (in the state that the punch 26*g* can accurately interfit the hole 27*h*1 of the die 27*h*). Each connecting pin 28 is fitted with each bushing 29 so as to be able to be inserted into or drawn out from each bushing. Each connecting pin 28 can attach to or detach from when they set each other at a given distance.

In the present embodiment, therefore, the punch unit 26 and the die unit 27, integrally connected by the connecting pin 28, can be integrally rotated about the central axis line L of the punching direction (vertical direction), by unfastening six fixing bolts 26*a* (or by detaching, if necessary) in the punch unit 26, and by unfastening eight fixation bolts 27*a*3 in the die unit 27. In contrast, the punch unit 26 and the die unit 27, integrally connected by the connecting pin 28, are not rotatably fixed at a desired rotational position when the six fixing bolts 26*a* of the punch unit 26 and the eight fixation bolts 27*a*3 of the die unit 27 are tightened.

The image pickup portion 30, used for detecting the displaced amount of the work from the reference location (for detecting the displaced amounts of the work in the X-axis, Y-axis, and the θ directions), provides a camera 31 for outputting analog image signals to an image processing controller (not shown). The image processing controller obtains the locations of two points marked on the work through the image analysis of the image signals, calculates each locational displacement in respective X, Y and θ directions, and outputs these displacements to a monitor (not shown). Furthermore, the displacements of the work can be compensated using the θ direction transfer mechanism 12, the X direction transfer mechanism 13, and the Y direction transfer mechanism 15 for restoring the work to the home position (to make the displacement in each direction zero). It is to be noted that the compensation of the displacements can be carried out by an automated operation.

The thus constructed punching apparatus according to the present embodiment is capable of providing the steps of compensating the work location, in the state that the punch unit 26 and the die unit 27 are set into the predetermined positions (the connecting pin is removed in this state), into the home position prior to the punching operation by use of the θ direction transfer mechanism 12, the X direction transfer mechanism 13, and the Y direction transfer mechanism 15, and moving the work to a punching position by use of the θ direction transfer mechanism 12, the X direction transfer mechanism 13, and the Y direction transfer mechanism 15, and carrying out the punching operation by means of the punch 26*g* and the die 27*h* (when a plurality of holes are to be punched, the punching operations are carried out in sequence). When the punching operation is to be carried out for a predetermined number of works, the above procedure is repeatedly executed. It is noted in this case, however, if the automated work supply and delivery can be carried out with high accuracy, the compensation operation of the work to the home position can be omitted.

In the punching apparatus according to the present embodiment, it is possible to punch a quadrangular hole at a desired location using the punch 26*g* and the die 27*h* by a series of following operational steps at the time of setting the punching unit 26 and the die unit 27: (1) unfastening the six fixing bolts 26*a* of the punch unit 26 (detaching these bolts if necessary) and unfastening the fixation bolts 27*a*3 of the die unit 27; (2) lowering the punch unit so as to integrally connect the punch unit 26 and the die unit 27 by the connecting pin 28; (3) integrally rotating the punch unit 26 and the die unit 27 integrally connected by the connecting pin 28 about the centeral axis line of the punching direction (vertical direction) to a desired position; (4) tightening the six fixing bolts 26*a* of the punching unit 26 and tightening the eight fixation bolts 27*a*3 of the die unit 27; (5) raising the punch unit 26 so as to remove the connecting pin 28 from the punch unit 26 and the die unit 27.

To sum up, since the punching apparatus according to the present embodiment is capable of fixing the punch 26*g* and the die 27*h* at a desired position by rotating the punch 26*g* and the die 27*h* about the central axis line of the punching direction, it is possible to increase the degree of freedom in setting the punch 26*g* and the die 27*h* and to punch the quadrangular hole at a desired position, even when the rotational range in setting the work is restricted.

Furthermore, the work supporting portion 10 are constructed so as to be transferred in a horizontal plane into two directions (X and Y directions) by the X direction transfer mechanism 13 and the Y direction transfer mechanism 15, and so as to be swingable in the angular direction about the base center point P by the θ direction transfer mechanism 12.

Furthermore, the connecting pin 28 adopted for connecting the punch 26*g* and the die 27*h* allows integral rotation of both the punch 26*g* and the die 27*h*, easy setting of the punch 26*g* and the die 27*h* before punching, and reduction of the time for the setting operation, which are effective for punching a variety of quadrangular holes in works with multiple types but small quantities. In addition, since the connecting pin 28 is attachable and detachable for both the punch 26*g* and the die 27*h*, it becomes possible to detach the connecting pin from both punch 26*g* and the die 27*h*. The connecting pin 28 does not disturb the punching operation and assists an easy punching operation for the work.

In the above embodiment, it is provided that the punch 26*g* and the die 27*h* can be rotated in any arbitrary direction. However, it is possible to set the rotational range of the punch 26*g* and the die 27*h* in a small restricted angular range such as 10 degrees or 20 degrees. In the above description, the image pickup portion 30 is used for detecting the location of the work supported by the work supporting portion 10. However, it should be understood that the other device can be used by replacing the image pickup portion 30 with the other sensor (such as a sensor for detecting the rotation of the supporting axis 12*a* in the θ direction transfer mechanism 12).

In the above embodiment, a simple and a low cost construction of the punch 26*g* and the die 27*h* by the connecting pin 28 is adopted, but it is possible to replace the connecting pin 28 with other connecting member (if the connecting member is attachable to and detachable from both of the punch 26*g* and the die 27*h*, irrespective of their being monolithic or complex bodies.

In the above embodiment, although the punch unit 26 and the die unit 27 are manually rotated after being integrally connected by the connecting pin 28, alternative methods may be used such that the punch unit 26 and the die unit 27 are manually rotated individually, or such that the punch unit 26 and the die unit 27 are respectively rotated by actuators (in this case, it is also possible to detect respective rotations of the punch unit 26 and the die unit 27 in order to improve the operability by controlling the actuation of the actuators by a control unit such that the punch unit 26 and the die unit 27 are in the same rotational phase).

In the above embodiment, the punching apparatus is constructed such that the punching unit 26 is fixed by the six fixing bolts 26*a* and the die unit 27 is fixed by the eight fixation bolts 27*a*3. However, an alternative can be adopted in which the punch unit 26 and the die unit 27 are separately fixed and capable of being clamped and released by respective chucks driven by actuators. In this case, it is preferable to construct the chuck mechanism so as not be released at the time of the punching operation.

What is claimed is:

1. An apparatus for punching a hole in an item, the apparatus comprising:

a punch having a first cross section which is non-circular, said punch being rotatable about an axis perpendicular to said first cross section and fixable at a first rotation phase;

a die having a second cross section which is non-circular, said die being rotatable about said axis and fixable at said first rotation phase; and a connecting portion which connects said punch with said punch die such that said connecting portion, said punch and said die are rotatable about said axis, said connecting portion being detachable from said punch and said die so as to perform a punching operation.

2. An apparatus for punching a hole in an item according to claim 1, wherein said first cross section and said second cross section are polygonal.

3. An apparatus for punching a hole in an item according to claim 1, further comprising an item support portion arranged so as to support said item between said punch and said die.

4. An apparatus for punching a hole in an item according to claim 3, wherein said item supporting portion is movable in two horizontal directions in a plane which is perpendicular to said axis and is swingable in said plane.

5. An apparatus for punching a hole in an item according to claim 1, wherein said punch and said die rotate with an identical rotation phase.

6. An apparatus for punching a hole in an item according to claim 5, wherein said connecting portion is operable to rotate said punch and said die with said identical rotation phase.

7. A hole punching apparatus comprising:

a punch holder;

a punch rotatably mounted on said punch holder about an axis of rotation;

a die holder;

a die rotatably mounted on said die holder, said die being rotatable about said axis of rotation; and at least one connecting member connecting said punch to said die, said connecting member allowing said punch and said die to rotate around said axis of rotation while connected, and said connecting member being rotatable about said axis of rotation, wherein said at least one connecting member is detached from said punch and said die before a punching operation is carried out.

8. The hole punching apparatus according to claim 7, wherein said punch and said die holder are fixable in at least one location about said axis of rotation.

9. The hole punching apparatus according to claim 7, wherein said punch and said die have non-circular cross-sections.

10. The hole punching apparatus according to claim 9, wherein said cross-sections of said punch and said die are polygonal.

11. The hole punching apparatus according to claim 7, further comprising a support portion arranged so as to support an item to be punched between said punch holder and said die holder.

12. The hole punching apparatus according to claim 11, wherein said support portion is moveable in a plane perpendicular to said axis of rotation.

13. The hole punching apparatus according to claim 12, wherein said support portion is moveable about a pivot point which is parallel to said axis of rotation.

14. An apparatus for punching a non-circular hole at a predetermined position of a workpiece, the punching apparatus comprising:

a punch holder;

a die holder facing said punch holder;

a hoisting device which is connected to said punch holder and moves said punch holder vertically toward said die holder along a punch moving axis;

a punch unit installed on said punch holder so as to rotate about said punch moving axis, said punch unit having a punch with a non-circular cross-section mounted thereto; and a die unit installed on said die holder so as to rotate about said punch moving axis, said die unit having a die with a non-circular cross-section mounted thereto; and a connecting portion connecting said punch unit with said die unit, said connecting portion comprising a connecting pin for connecting between a hole formed in said punch unit and a hole formed in said die unit, wherein, when said connecting pin is engaged with both said hole of said punch unit and with said hole of said die unit, said punch unit and said die unit are integrated such that said punch and said die are rotatable at the same phase, and when said punch unit and said die unit are respectively fixed to said punch holder and said die holder, and said connecting pin is detached from both said hole of said punch unit and from said hole of said die unit, the punching operation is carried out for punching a hole in the workpiece.

* * * * *